US007575188B2

(12) United States Patent
Mullen et al.

(10) Patent No.: US 7,575,188 B2
(45) Date of Patent: Aug. 18, 2009

(54) FOLDING CRANK HANDLE FOR HOSE REEL

(75) Inventors: Joshua O. Mullen, Duncannon, PA (US); Stephen D. Hatcher, Dillsburg, PA (US)

(73) Assignee: Ames True Temper, Inc., Camp Hill, PA (US)

( * ) Notice: Subject to any disclaimer, the term of this patent is extended or adjusted under 35 U.S.C. 154(b) by 12 days.

(21) Appl. No.: 12/001,855

(22) Filed: Dec. 13, 2007

(65) Prior Publication Data

US 2009/0151484 A1 Jun. 18, 2009

(51) Int. Cl.
*B65H 75/38* (2006.01)

(52) U.S. Cl. ..... 242/405.2; 242/405.3; 242/588.2; 137/355.26

(58) Field of Classification Search ..... 242/564.2, 242/405.2–405.3, 588.2, 395.1; 137/355.26–355.27
See application file for complete search history.

(56) References Cited

U.S. PATENT DOCUMENTS 5,425,391 A * 6/1995 Tisbo et al. ..... 137/15.01
5,901,730 A * 5/1999 Tisbo et al. ..... 137/15.01
5,934,598 A * 8/1999 Kovacik et al. ..... 242/395
5,988,552 A 11/1999 Tisbo et al.
6,834,670 B2 12/2004 Rosine et al.
7,017,603 B1 * 3/2006 Rosine et al. ..... 137/355.12

* cited by examiner

*Primary Examiner*—Sang Kim
(74) *Attorney, Agent, or Firm*—Eckert Seamans Cherin & Mellott, LLC; David C. Jenkins, Esq.

(57) ABSTRACT

A crank assembly having a crank arm with a handle member pivotally coupled thereto is provided. The handle member includes a lock assembly with a crank component and a handle component. The crank component includes a latch surface on a crank arm outer surface. The lock assembly handle component is, preferably, at least one extension extending from the handle member and structured to engage the latch surface. The lock assembly handle component further has a release device structured to disengage the at least one extension from the latch surface. The release device is accessible from the crank arm outer surface. In this configuration, a user may easily access the release device because the release device is located on the outer surface of the crank arm.

12 Claims, 6 Drawing Sheets

FOLDING CRANK HANDLE FOR HOSE REEL

BACKGROUND OF THE INVENTION

1. Field of the Invention

The present invention relates to a hose reel and, more specifically, to a folding crank handle for a hose reel.

2. Background Information

Hose reel assemblies are devices structured to assist in transporting and using hoses, typically garden hoses for dispensing water. Generally, the hose reel assembly includes a base, frame, or housing assembly structured to rotatably support a reel, or "basket assembly." The basket assembly's primary components are a barrel, around which an outlet hose is wrapped, two hubs which are coupled to the housing assembly, and guide plates which define the usable area of the barrel. The basket assembly also includes a crank, used to turn the basket primary components, and a water conduit having a movable outlet and a generally stationary inlet. The stationary inlet of the conduit extends away from the reel and is structured to be coupled to a supply hose which is further coupled to a water supply. The movable outlet of the conduit is disposed on the circumference of the reel. The outlet hose is coupled to the movable outlet and is used to deliver water to the end use. Hose reel assemblies also may include an autotrack device structured to wind the outlet hose on the reel in a controlled manner. In this configuration, an outlet hose may be coupled to the movable end of the conduit and, when the reel is rotated, the hose is wrapped, or unwrapped, about the reel. Thus, a hose may be transported and/or stored on the hose reel assembly.

The hose reel assembly, typically, is made of plastic and sold in a disassembled state. While manufacturers try to make the assembly of a typical hose reel relatively simple, there are many components of a hose reel assembly that are difficult for some users to install or assemble. As such, manufacturers try to include as many preinstalled components as possible. The disadvantage to having preinstalled components, however, is that some components, especially those like the crank handle that extend away from the body of the hose reel, require additional room in the shipping container and/or storage box. Accordingly, some manufacturers have devised structures that are partially collapsible, such as a folding crank handle, that reduce the volume/size of the hose reel during shipping. Unfortunately, these structures were also designed to snap into an extended position and not be collapsed again. Thus, the next generation of folding crank handles were structured to allow the user to release the crank handle so that the crank handle could be returned to the retracted position. The release devices, however, were typically hard to reach and difficult to actuate. For example, the folding crank handle disclosed in U.S. Pat. No. 6,834,670 used a pawl and detent locking device wherein the user was required to reach behind the handle to access a locking tab. Given that the handle is disposed immediately adjacent to the housing assembly, accessing the locking tab could be difficult.

There is, therefore, a need for a folding crank handle wherein the crank handle release device is easy to access.

There is a further need for a folding crank handle wherein the crank handle latching device is disposed on the outer surface of the crank assembly.

SUMMARY OF THE INVENTION

These needs, and others, are met by at least one embodiment of the claimed invention wherein a crank assembly has a crank arm with a handle member pivotally coupled thereto. The handle member includes a lock assembly with a crank component and a handle component. The crank component includes a latch surface on a crank arm outer surface. The lock assembly handle component is, preferably, at least one extension extending from the handle member and structured to engage the latch surface. The lock assembly handle component further has a release device structured to disengage the at least one extension from the latch surface. The release device is accessible from the crank arm outer surface. In this configuration, a user may easily access the release device because the release device is located on the outer surface of the crank arm.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As used herein, the word "unitary" means a component is created as a single piece or unit. That is, a component that includes pieces that are created separately and then coupled together as a unit is not a "unitary" component or body.

As used herein, a "uniform surface" has generally the same texture across the surface. Such a "uniform surface" may be smooth or uniformly textured. A "uniform surface" does not have any localized pits, detents, or deformations.

Figure 1:
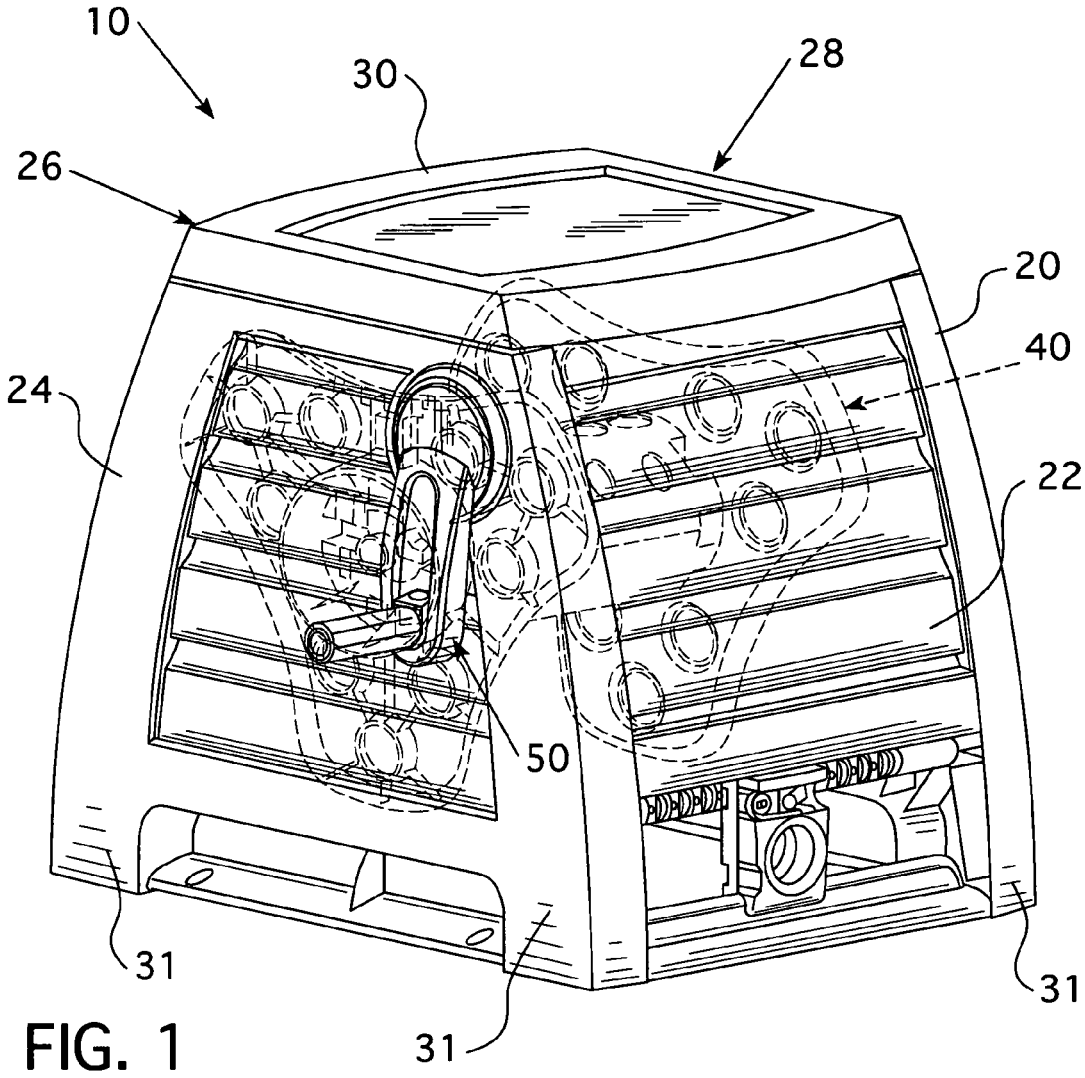
FIG. 1 is an isometric view of a hose reel.

As shown in FIG. 1, a hose reel assembly 10 includes a housing assembly 20 and a basket assembly 40. The housing assembly 20 may be a frame (not shown) but is shown as including a front side 22, a first lateral side 24, a back side 26, a second lateral side 28, and a top member 30. The front side 22 and the back side 26 are each coupled to the first and second lateral sides 24, 28 and disposed in a spaced, generally parallel configuration. The first and second lateral sides 24, 28 are also disposed in a spaced, generally parallel configuration. Thus, the housing assembly 20 is generally a rectangular shape. A foot 31 is located at each corner of the housing assembly 20. The front side 22, first lateral side 24, back side 26, and second lateral side 28 may include a decorative pattern.

Figure 2:
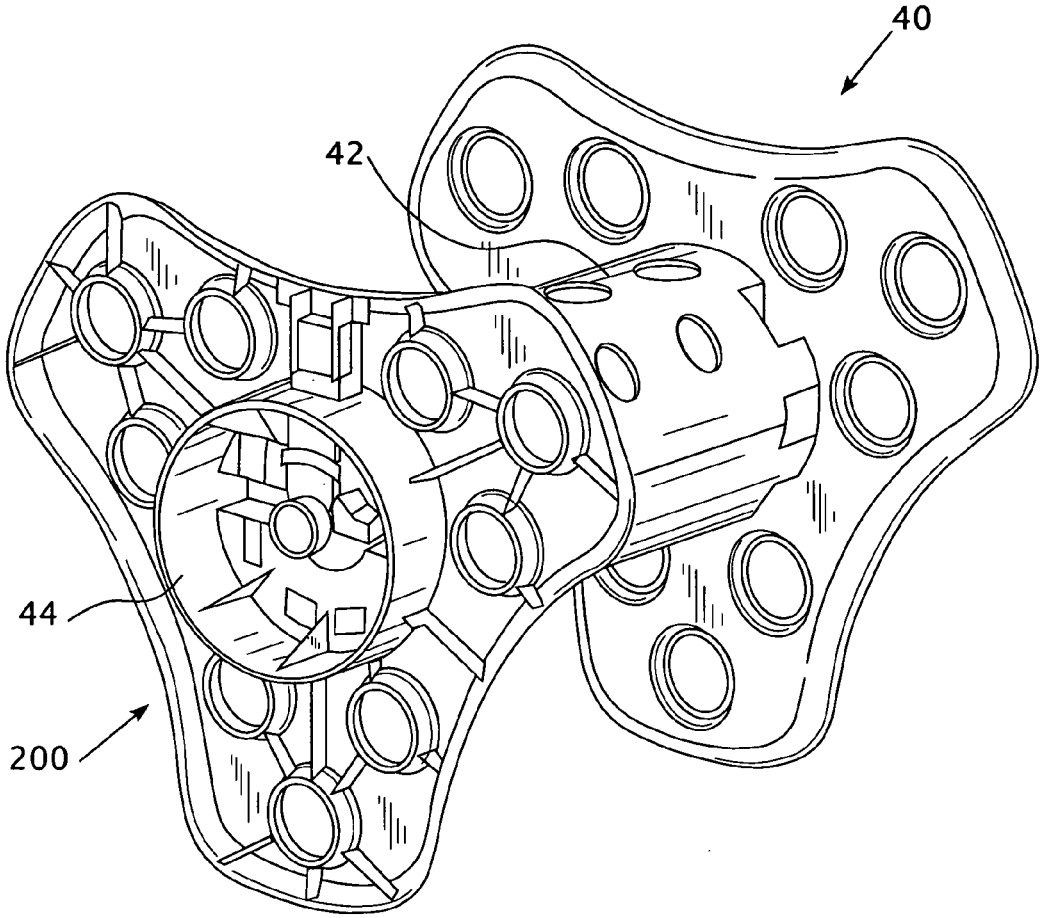
FIG. 2 is an isometric view of a basket assembly.

As shown in FIG. 2, the basket assembly 40 includes an elongated barrel 42 with two axial hubs 44, a crank assembly 50 (FIG. 1), and a water system 200. The hubs 44 are rotatably coupled to the housing assembly 20, preferably to the first and second lateral sides 24, 28. In this configuration, the barrel 42 may be rotated about its longitudinal axis while disposed within the housing assembly 20. The crank assembly 50 rotatably engages the barrel 42 either directly or via one or more gears, a belt, or other coupling device structured to transfer rotational motion (not shown). That is, the crank assembly 50 is structured to rotate the barrel 42 within the housing assembly 20.

Figure 3:
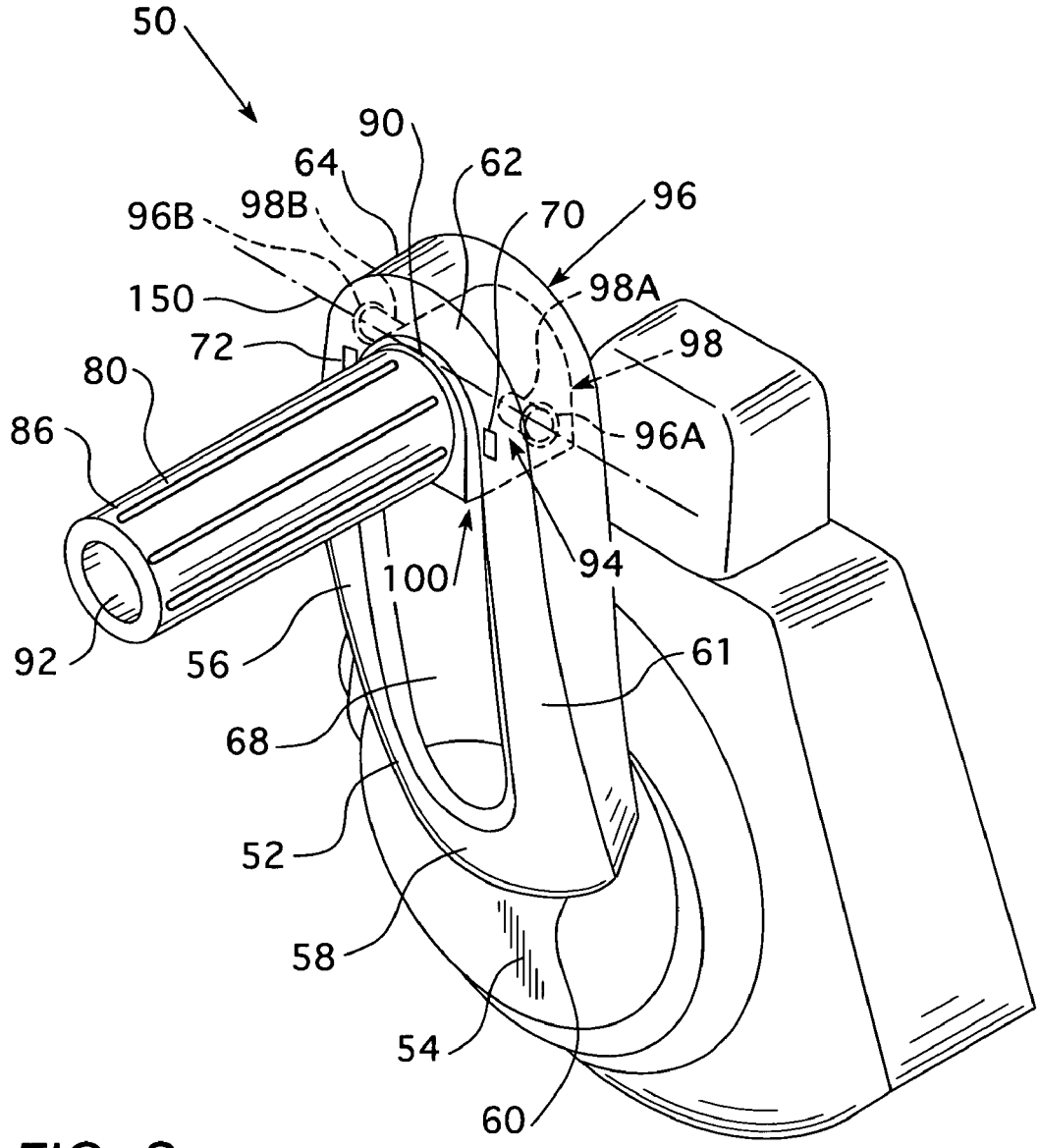
FIG. 3 is an isometric view of a crank assembly.
Figure 4:
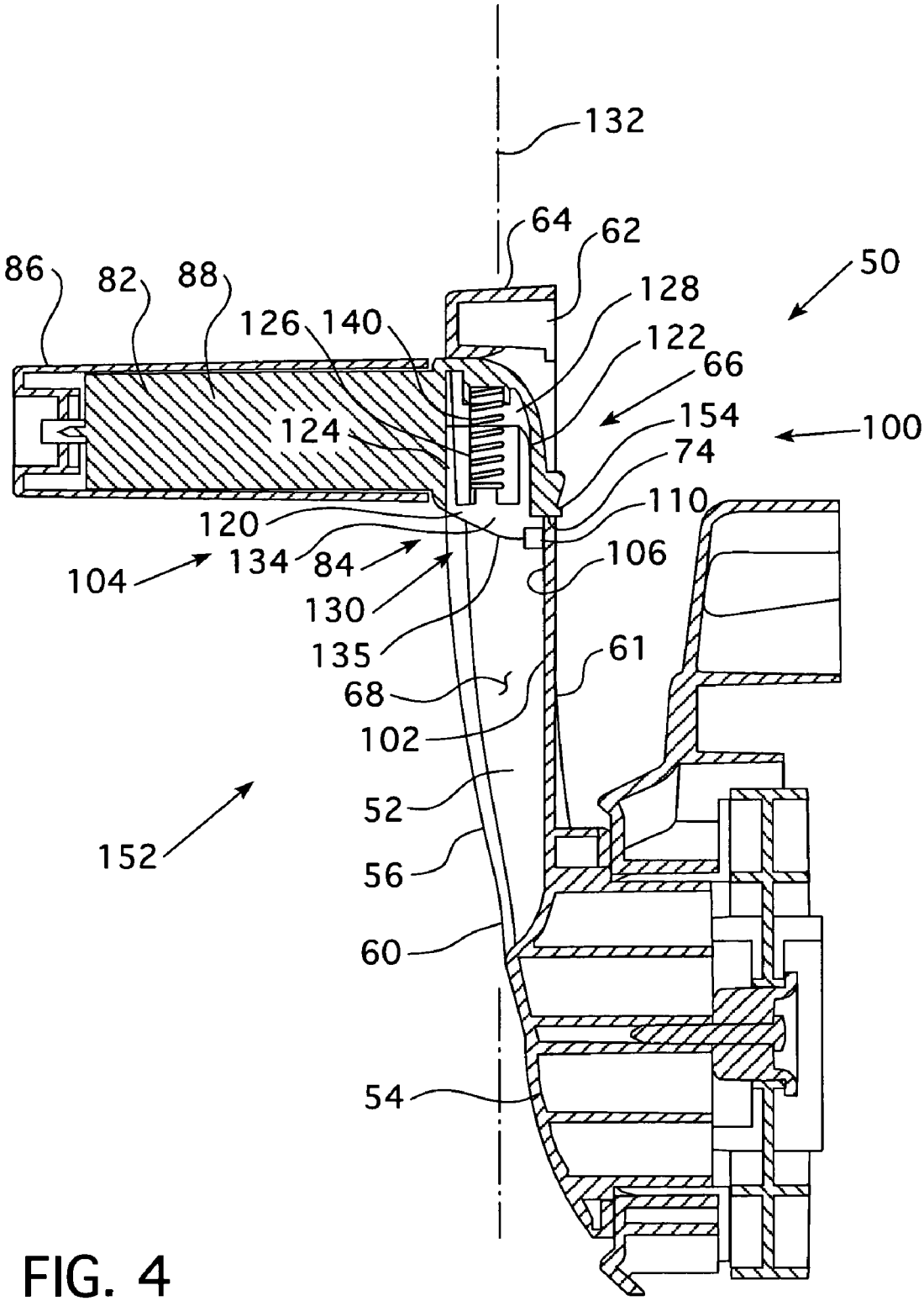
FIG. 4 is a cross-sectional view of a crank assembly with a handle in a second position.
Figure 5:
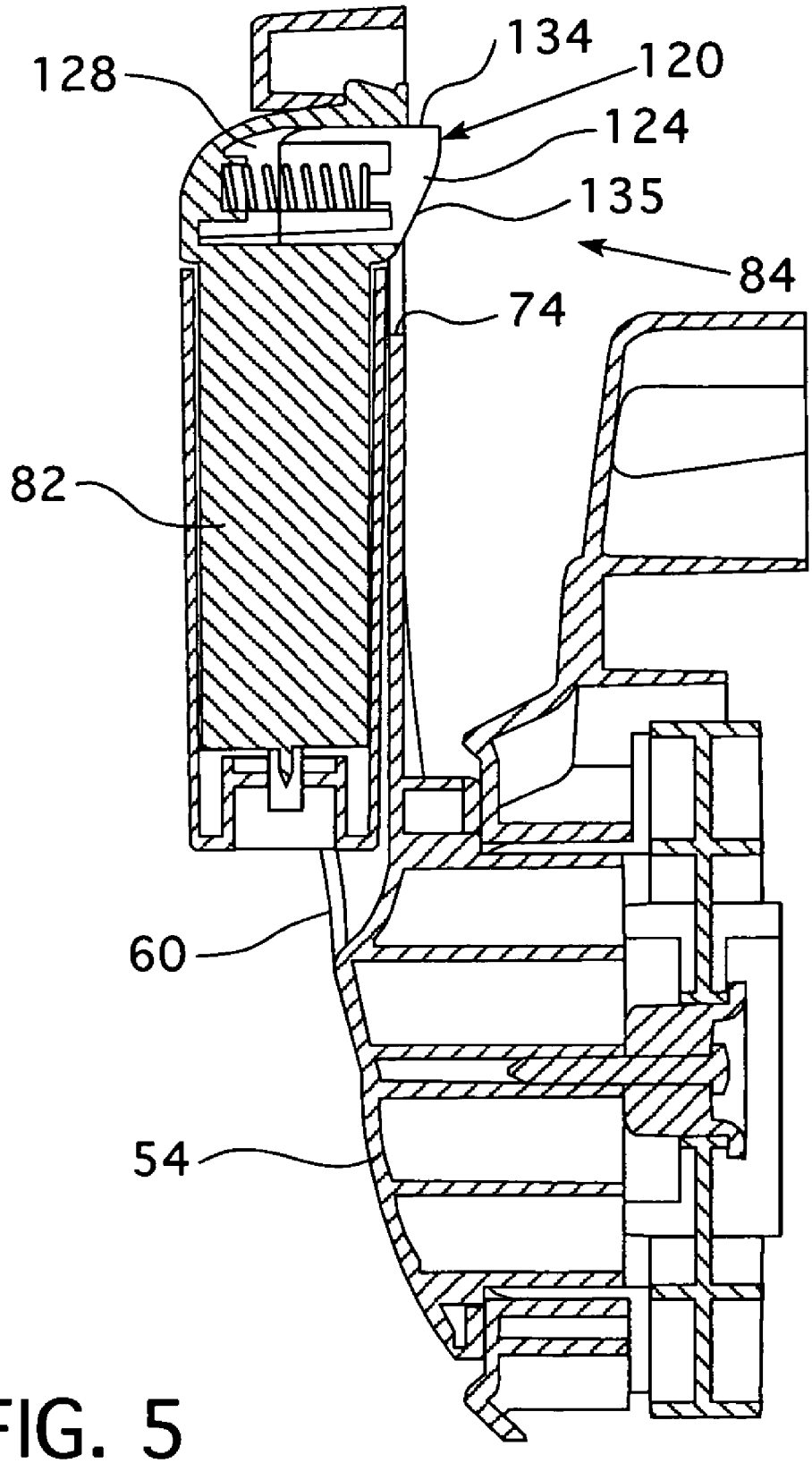
FIG. 5 is a cross-sectional view of a crank assembly with a handle in a first position.

As shown in FIGS. 3-5, the crank assembly 50 includes a crank member 52, a handle assembly 80, and a lock assembly 100. The crank member 52 includes a hub 54 and an elongated, generally radially extending arm 56. The crank hub 54 is rotatably coupled to the housing assembly 20 and, as noted above, rotatably engages the barrel 42. The crank arm 56 has an outer surface 58, a first end 60, a medial portion 61, and a second end 62 with a distal tip 64. The crank arm first end 60 is coupled to, or formed integrally with, the crank hub 54. The crank arm second end 62 includes a handle opening 66 (FIG. 4). The crank arm outer surface 58 is generally exposed when the crank assembly 50 is coupled to the housing assembly 20. The crank arm outer surface medial portion 61 may include an indentation 68 sized and shaped to accommodate at least a portion of the handle assembly 80. As set forth below, the handle member 82 is generally cylindrical. Thus, the indentation 68 is, preferably, a semicircular recess extending from the opening 66 towards the crank arm first end 60. The handle opening 66 includes two opposed, inner lateral sides 70, 72 that extend generally parallel to the longitudinal axis of the crank arm 56. The crank assembly 50 also includes a stop surface 74 (FIG. 4). The stop surface 74 is disposed adjacent to the latch surface 106 (described below).

The handle assembly 80 has an elongated handle member 82 and the lock assembly handle component 104 (described below) which is preferably a button assembly 84. The handle member 82 may have a rotating outer shell 86 as is known in the art. The handle member 82 (FIG. 4) has an elongated body 88 with a first end 90 and a second end 92. The handle member body first end 90 is pivotally coupled to the crank arm 56 by a pivot connection 94 (FIG. 3). The pivot connection 94 includes a first component 96 on the crank arm 56 and a second component 98 on the handle member 82. As shown in FIG. 3, the pivot connection first component 96 is a pair of aligned, opposed pivot openings 96A, 96B on the inner lateral sides 70, 72 of the crank arm 56. The pivot connection second component 98 is a pair of aligned pivot pins 98A, 98B extending from the handle assembly 80 and structured to be pivotally coupled with the pivot openings 96A, 96B. Thus, the handle member 82 is pivotally coupled to the crank arm 56 and structured to move between a first, retracted position, wherein the handle member 82 is disposed generally parallel to said crank arm 56 and a second, extended position, wherein handle member 82 is disposed generally perpendicular to the crank arm 56. When the handle member 82 is in the first position, the handle member 82 is at least partially disposed in the indentation 68.

The lock assembly 100 has a crank component 102 and a handle component 104 and is structured to releasably lock the handle member 82 in the second position. The lock assembly crank component 102 is a latch surface 106 (FIG. 4) on the crank arm outer surface 58. The latch surface 106 is generally uniform. Preferably, the latch surface 106 is disposed on the indentation 68 adjacent to the handle opening 66. At this location, the latch surface 106 is curved and corresponds to the curvature of the indentation 68.

Figure 6:
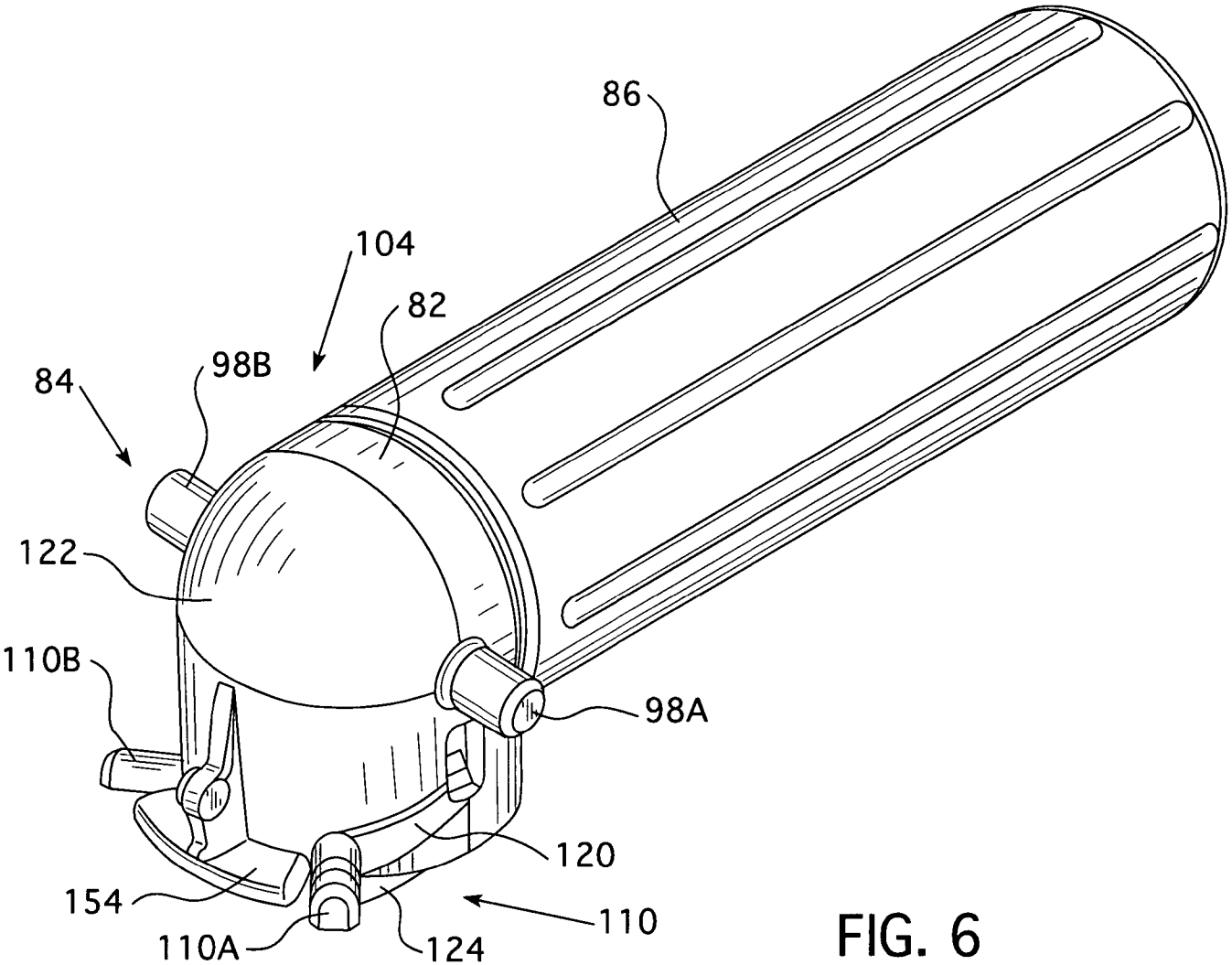
FIG. 6 is an isometric view of a handle assembly.

As shown in FIG. 6, the lock assembly handle component 104 is at least one extension 110 extending from the handle assembly 80 and structured to engage the latch surface 106. In the preferred embodiment, as shown, the at least one extension 110 includes two extensions 110A, 110B. The extensions 110A, 110B have a length and are positioned on the handle assembly 80 such that, when the extensions 110A, 110B contact the latch surface 106, the handle assembly 80 is generally perpendicular to the crank arm 56. The lock assembly handle component 104 further has a release device 120. The release device 120 is structured to disengage the at least one extension 110 from the latch surface 106. The release device 120 is accessible from the crank arm outer surface 58. That is, the at least one extension 110 is structured to move between a first, locking position and a second, release position.

The release device 120 is, preferably, the button assembly 84. The button assembly 84 has a sidewall 122, a button member 124 and a biasing device 126. As shown in FIGS. 4 and 5, the sidewall 122 defines a cavity 128 having an opening 130 and a motion axis 132 (FIG. 4). The motion axis 132 extends through the cavity opening 130. The sidewall 122 is coupled to, and may be formed integrally with, the handle member 82. That is, the handle member 82 and the sidewall 122 may be a unitary body. The button member 124 is slidably disposed partially within the cavity 128 and is structured to move between a first, locking position, wherein a portion of the button member 124 is disposed outside of the cavity 128, and a second, release position, wherein the button member 124 is disposed substantially within the cavity 128. That is, the button member 124 has an exposed portion 134 that extends through the cavity opening 130 when the button member 124 is in the first, locking position.

The axial face of the button member 124 on the button member exposed portion 134 is a button surface 135.

The biasing device 126, which is preferably a compression spring 140, is disposed within the cavity 128 and extends between the sidewall 122 and the button member 124. In this configuration, the biasing device 126 is structured to bias the button member 124 to said first, locking position. Further, the button member 124 is sized to generally correspond to the shape of the cavity 128. That is, the cavity 128 is, preferably, generally cylindrical and the button member 124 is a cylinder. In this configuration, the button member 124 moves in a generally linear manner along the motion axis 132 between the first and second positions. The at least one extension 110A, 110B is disposed on, and extends outwardly from, the button member exposed portion 134.

As set forth above, the handle member 82 is pivotally coupled to the crank arm 56. Thus, the handle member 82 has an axis of rotation 150 relative to the crank arm 56. The handle member axis of rotation 150 extends through the pivot pins 98A, 98B. The crank arm stop surface 74 extends generally parallel to the handle member axis of rotation 150. The sidewall 122 has an outer surface 152 and includes a handle stop member 154 extending therefrom. The handle stop member 154 is structured to engage said crank assembly stop surface 74 when the handle member 82 is in the second, extended position.

In this configuration, the button surface 135, which is the point which a user must press to release the lock assembly 100, is exposed when the handle member 82 is in the second, extended position. Thus, a user may stow the handle assembly 80 in the first, retracted position for storage and move the handle assembly 80 into the second, extended position for use. As the handle member 82 moves from the first, retracted position to the second, extended position, the handle member 82 passes through an intermediate position between said first, retracted position and said second, extended position. When the handle member 82 is in the intermediate position the at least one extension 110 engages the stop surface 74 and the continued motion of the handle member 82 toward the second, extended position causes the button member 124 to move toward the second, retracted position. With the button member 124 in the second, retracted position, the at least one extension 110 can move past the stop surface 74 to be disposed above the latch surface 106. The biasing device 126 causes the button member 124 to move back into the first, locking position and the at least one extension 110 engages the latch surface 106. In this configuration, the handle member 82 is locked in the second, extended position. To release the handle member 82, the user applies pressure to the button surface 135 causing the button member 124 to move into the second, retracted position. With the button member 124 in the second, retracted position, the at least one extension 110 can again move past the stop surface 74 while the user pivots the handle member 82 toward the first, retracted position.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A crank assembly for a hose reel assembly, said hose reel assembly having a housing assembly and a basket assembly, said basket assembly having a barrel that is rotatably coupled to said housing assembly, said crank assembly comprising:

a crank member having a hub and a generally radially extending arm;

said crank hub structured to be rotatably coupled to said housing assembly, said crank hub further structured to rotatably engage said barrel;

said crank arm having an outer surface, a first end and a second end with a distal tip, said crank arm first end coupled to said crank hub;

a handle assembly having an elongated handle member;

said handle member pivotally coupled to said crank arm and structured to move between a first, retracted position, wherein said handle member is disposed generally parallel to said crank arm, and a second, extended position, wherein said handle member is disposed generally perpendicular to said crank arm;

a lock assembly having a handle component and a crank component, said lock assembly structured to releasably lock said handle member in said second position;

said lock assembly crank component being a latch surface on said crank arm outer surface;

said lock assembly handle component being at least one extension extending from said handle assembly and structured to engage said latch surface;

said lock assembly handle component further having a release device, said release device structured to disengage said at least one extension from said latch surface, said release device being accessible from said crank arm outer surface;

said at least one extension is structured to move between a first, locking position and a second, release position;

said at least one extension being biased towards said first, locking position;

said handle member passes through an intermediate position between said first, retracted position and said second, extended position;

said crank assembly having a stop surface;

said stop surface disposed adjacent to said latch surface;

wherein, when said handle member is in said intermediate position, said at least one extension engages said stop surface;

said stop surface structured to cause said at least one extension to move into said second, release position as said handle member moves to said second position;

said release device includes a button assembly;

said button assembly having a sidewall, a button member and a biasing device;

said sidewall defining a cavity having an opening and a motion axis, said sidewall being coupled to said handle assembly;

said button member slidably disposed partially within said cavity and structured to move between a first, locking position and a second, release position, said button member having an exposed portion that extends through said cavity opening when said button member is in said first, locking position;

said biasing device disposed within said cavity and between said sidewall and said button member, said biasing device structured to bias said button member to said first, locking position; and said at least one extension coupled to said button member exposed portion.

2. The crank assembly of claim 1 wherein said at least one extension moves generally linearly between said first, locking position and said second, release position.

3. The crank assembly of claim 1 wherein said button member has a button surface structured to be engaged by a user.

4. The crank assembly of claim 1 wherein:

said button assembly sidewall includes at least one slot extending generally parallel to the motion axis;

said button member having at least one lateral stop member, said at least one lateral stop member positioned so that, when said button member is disposed partially within said cavity, said at least one lateral stop member is disposed within said at least one slot; and wherein the range of travel of said button member within said cavity is limited by said at least one lateral stop member contacting at least one end of said at least one slot.

5. The crank assembly of claim 1 wherein:

said handle member has an axis of rotation relative to said crank arm;

said crank arm stop surface extending generally parallel to said handle member axis of rotation;

said sidewall has an outer surface and includes a handle stop member, said handle stop member extending from said outer surface; and wherein, said handle stop member is structured to engage said crank arm stop surface when said handle member is in said second, extended position.

6. The crank assembly of claim 5 wherein said handle member is in said second, extended position when said handle member is generally perpendicular to said crank arm.

7. A hose reel assembly comprising:

a housing assembly;

a basket assembly structured to be rotatably coupled to said housing assembly, said basket assembly having an elongated barrel with two axial hubs, and a crank assembly, said crank assembly coupled to said barrel and structured to rotate said barrel relative to said housing assembly;

said crank assembly having a crank member with a hub and a generally radially extending arm;

said crank hub structured to be rotatably coupled to said housing assembly, said crank hub further structured to rotatably engage said barrel;

said crank arm having an outer surface, a first end and a second end with a distal tip, said crank arm first end coupled to said crank hub;

a handle assembly having an elongated handle member;

said handle member pivotally coupled to said crank arm and structured to move between a first, retracted position, wherein said handle member is disposed generally parallel to said crank arm, and a second, extended position, wherein said handle member is disposed generally perpendicular to said crank arm;

a lock assembly having a handle component and a crank component, said lock assembly structured to releasably lock said handle member in said second position;

said lock assembly crank component being a latch surface on said crank arm outer surface;

said lock assembly handle component being at least one extension extending from said handle assembly and structured to engage said latch surface;

said lock assembly handle component further having a release device, said release device structured to disengage said at least one extension from said latch surface, said release device being accessible from said crank arm outer surface;

said at least one extension is structured to move between a first, locking position and a second, release position;

said at least one extension being biased towards said first, locking position;

said handle member passes through an intermediate position between said first, retracted position and said second, extended position;

said crank assembly having a stop surface;

said stop surface disposed adjacent to said latch surface;

wherein, when said handle member is in said intermediate position, said at least one extension engages said stop surface;

said stop surface structured to cause said at least one extension to move into said second, release position as said handle member moves to said second position;

said release device includes a button assembly;

said button assembly having a sidewall, a button member and a biasing device;

said sidewall defining a cavity having an opening and a motion axis, said sidewall being coupled to said handle assembly;

said button member slidably disposed partially within said cavity and structured to move between a first, locking position and a second, release position, said button member having an exposed portion that extends through said cavity opening when said button member is in said first, locking position;

said biasing device disposed within said cavity and between said sidewall and said button member, said biasing device structured to bias said button member to said first, locking position; and said at least one extension coupled to said button member exposed portion.

8. The hose reel assembly of claim 7 wherein said at least one extension moves generally linearly between said first, locking position and said second, release position.

9. The hose reel assembly of claim 7 wherein said button member has a button surface structured to be engaged by a user.

10. The hose reel assembly of claim 7 wherein:

said button assembly sidewall includes at least one slot extending generally parallel to the motion axis;

said button member having at least one lateral stop member, said at least one lateral stop member positioned so that, when said button member is disposed partially within said cavity, said at least one lateral stop member is disposed within said at least one slot; and wherein the range of travel of said button member within said cavity is limited by said at least one lateral stop member contacting at least one end of said at least one slot.

11. The hose reel assembly of claim 7 wherein:

said handle member has an axis of rotation relative to said crank arm;

said crank arm stop surface extending generally parallel to said handle member axis of rotation;

said sidewall has an outer surface and includes a handle stop member, said handle stop member extending from said outer surface; and wherein, said handle stop member is structured to engage said crank arm stop surface when said handle member is in said second, extended position.

12. The hose reel assembly of claim 11 wherein said handle member is in said second, extended position when said handle member is generally perpendicular to said crank arm.

* * * * *